US007304246B2

(12) United States Patent
Huffman

(10) Patent No.: US 7,304,246 B2
(45) Date of Patent: Dec. 4, 2007

(54) DESIGN FOR LINEAR BROADBAND LOW FREQUENCY CABLE

(76) Inventor: Grover Scott Huffman, 22665 Cantara St., West Hills, CA (US) 91304

( * ) Notice: Subject to any disclaimer, the term of this patent is extended or adjusted under 35 U.S.C. 154(b) by 0 days.

(21) Appl. No.: 11/352,596

(22) Filed: Feb. 13, 2006

(65) Prior Publication Data

US 2006/0180339 A1 Aug. 17, 2006

Related U.S. Application Data

(60) Provisional application No. 60/652,656, filed on Feb. 15, 2005.

(51) Int. Cl.
*H01B 7/08* (2006.01)

(52) U.S. Cl. ..... 174/117 FF

(58) Field of Classification Search ..... 174/117 FF
See application file for complete search history.

(56) References Cited

U.S. PATENT DOCUMENTS 2,060,913 A * 11/1936 Weaver ..... 174/69
2,200,776 A * 5/1940 Hoover ..... 156/55
3,586,757 A * 6/1971 Haldeman, Jr. ..... 174/117 FF
4,582,545 A 4/1986 Kamada et al.
5,105,055 A * 4/1992 Mooney et al. ..... 174/27
5,171,938 A * 12/1992 Katsumata et al. ..... 174/36
RE34,641 E 6/1994 Kamada et al.
5,500,489 A 3/1996 Shah et al.
6,225,563 B1 5/2001 Poulsen
6,653,570 B1 11/2003 Elrod
6,809,256 B2 10/2004 Garland
6,969,805 B2 11/2005 Lee et al.
2006/0169481 A1* 8/2006 Stotz ..... 174/117 F

* cited by examiner

*Primary Examiner*—Chau N. Nguyen

(57) ABSTRACT

Embodiments of the present invention describe a cable assembly comprising at least two conductors wherein the width of the cross-sectional profile of each said at least two conductors is substantially larger than the height wherein each conductor is in electric contact with at least one other conductor; and at least one jacket comprising an insulating material and surrounding the conductors.

3 Claims, 9 Drawing Sheets

DESIGN FOR LINEAR BROADBAND LOW FREQUENCY CABLE

CROSS-REFERENCE TO RELATED APPLICATIONS

This application claims benefit of priority from U.S. Provisional Patent Application 60/652,656 filed Feb. 15, 2005 and is hereby incorporated by reference in its entirety.

FIELD OF INVENTION

The present invention relates generally to a cable assembly for transmission of electrical signals and more specifically for transmission of analogue alternating current signals.

BACKGROUND

Conductors of electrical current commonly referred to as wire have been used for transmission of electric energy since the discovery of electricity. Various forms and configurations of conductors are commonly known, as well as the dielectrics used for insulating the same. Commonly used wires have solid metal conductors with a circular cross-section that are insulated with a tight dielectric outer skin. Also common are stranded wires consisting of several circular-cross sectioned conductors bundled to act as a single conductor again with a tight dielectric outer skin. However, these designs typically suffer from loss of signal quality such as loss of linearity at low and high frequency extremes as well as distortion of the signal caused by factors of conductor construction and positions of conductors within the dielectric skin.

The aforementioned bundled design intends for the high frequencies to flow through the surface area of small-diameter individual conductors while the lower frequencies flow through the larger bundled conductors as a whole. Such early designs decreased impedance for both low and high frequencies.

In yet another design, a ribbon conductor (i.e. conductor cross-sectional height being smaller that cross-sectional width) is used with a tight dielectric outer skin. This conductor geometry is so designed such the higher frequencies utilize the relatively short height, while the lower frequency signals utilize the relatively larger width for flow. However, this design suffers from practical limits of the ribbon dimensions and resistance which consequently limit current flow. For transmittance of a full audio signal bandwidth, the required width of the ribbon design poses a major practical limitation. Embodiments of the present invention describe a novel cable assembly, for improved signal transmission which does not suffer from the aforementioned drawbacks. The cable assembly allows for a very broadband signal transmission with minimal loss of quality i.e. distortion) while improving harmonic integrity at frequency extremes, and having greater current potential with less resistance, while compacting the space required within the dielectric jacket.

SUMMARY OF THE INVENTION

Embodiments of the present invention describe a cable assembly comprising at least two conductors wherein the width of the cross-sectional profile of each said at least two conductors is substantially larger than the height and wherein each conductor is in electrical contact with at least one other conductor; and at least one jacket comprising an insulating material and surrounding the conductors.

DESCRIPTION

Figure 1:
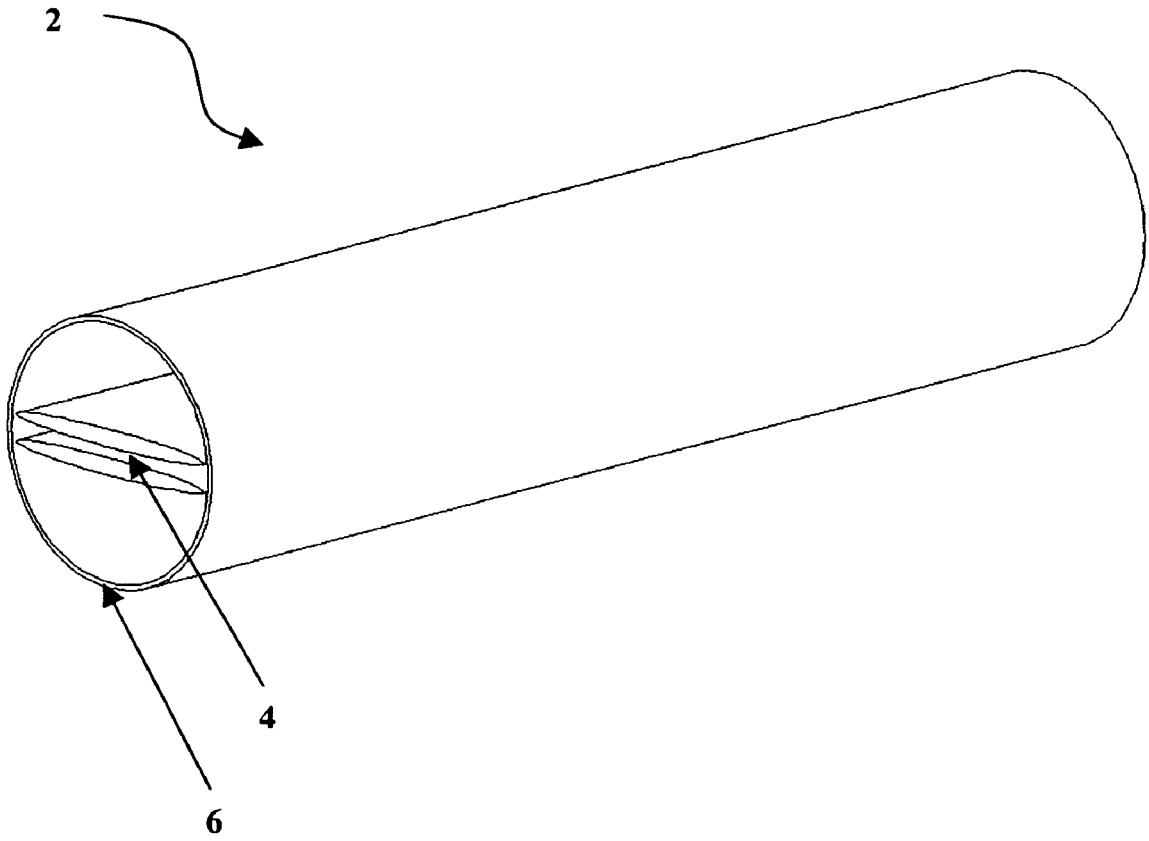
FIG. 1 represents an isometric view of a cable assembly comprising conductors in a rigid jacket.
Figure 2:
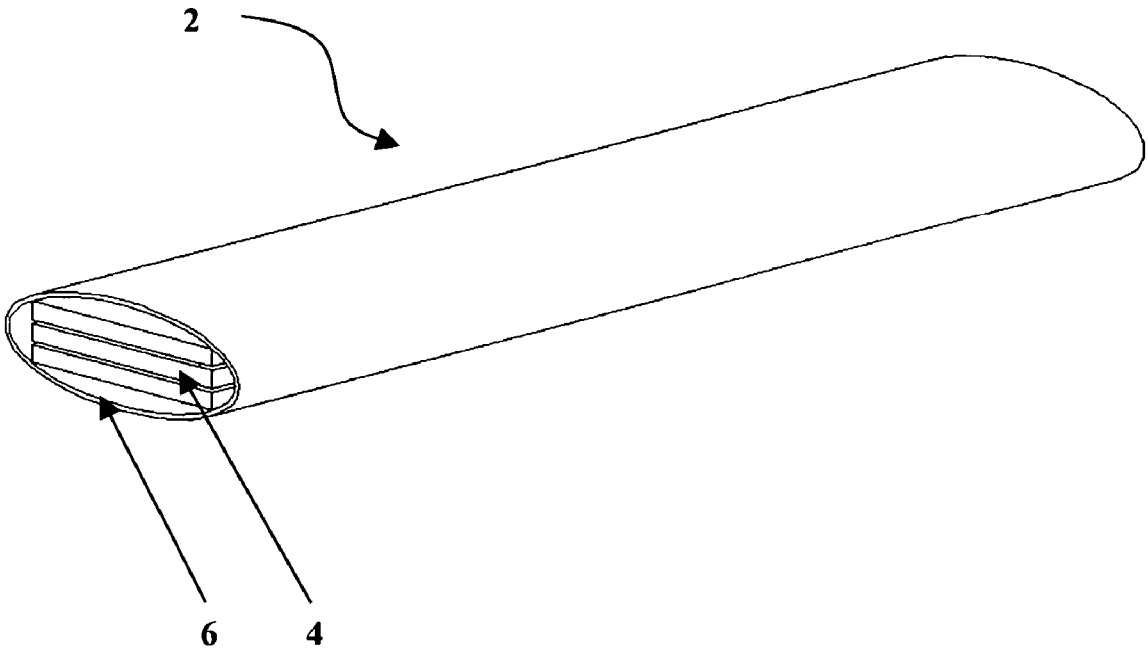
FIG. 2 represents an isometric view of a cable assembly with conductors in a conforming jacket.
Figure 3:
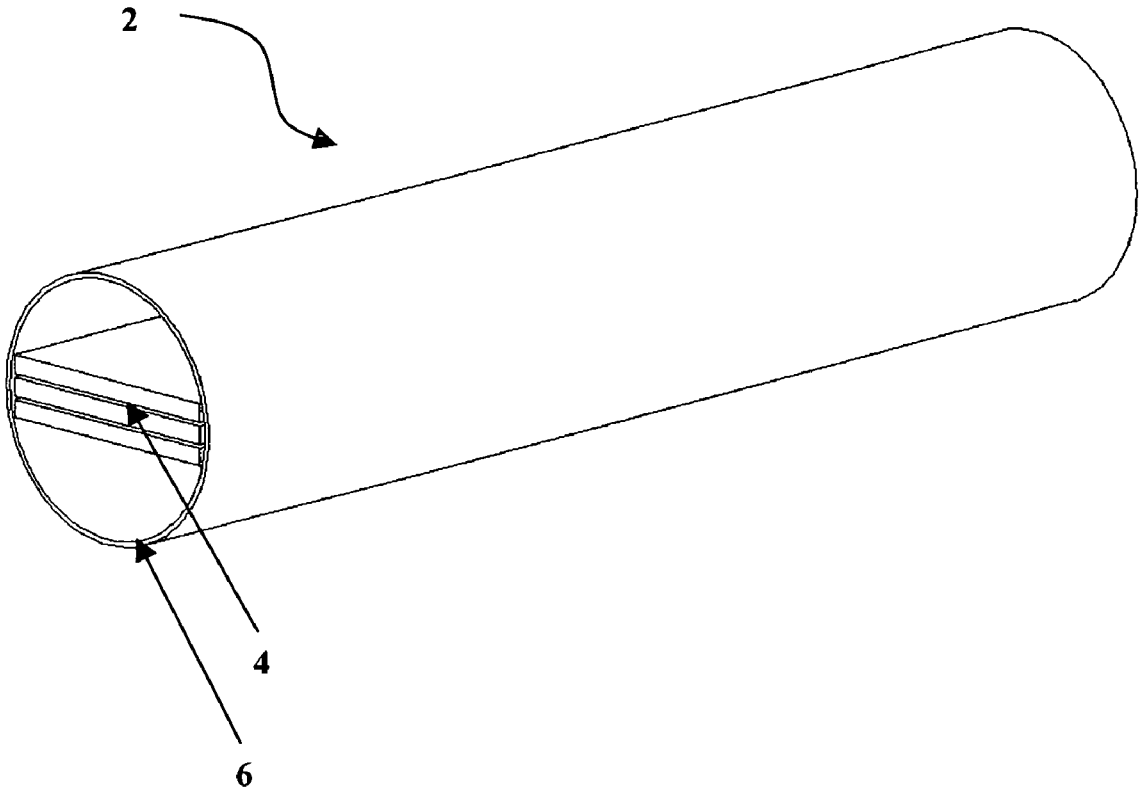
FIG. 3 represents another isometric view of a cable assembly comprising conductors in a rigid jacket.
Figure 4:
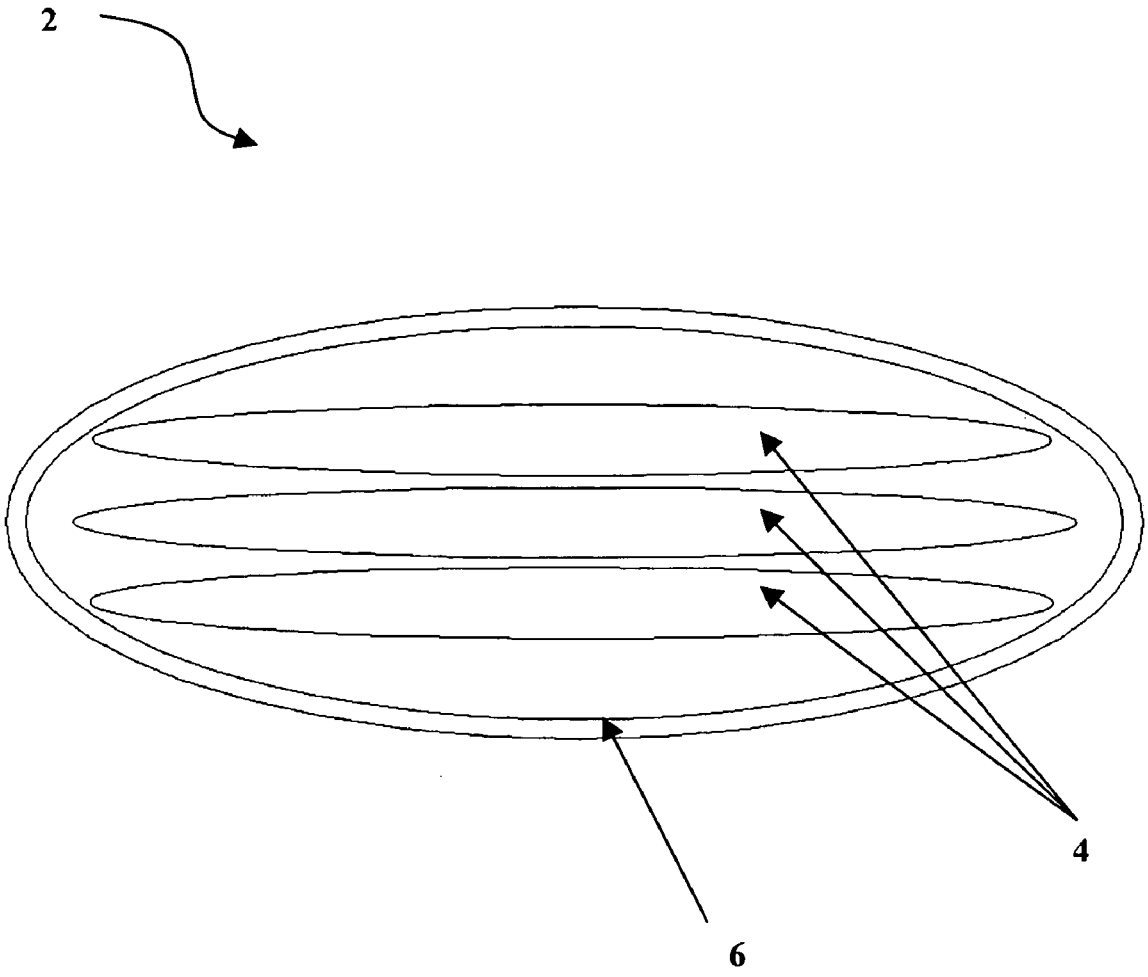
FIG. 4 represents a cross-sectional view of cable assembly.

Embodiments of the present invention describe a cable assembly for transmitting electrical signals. Transmission of audio signals is of particular interest although video and other such signals in addition to alternating and direct currents are equally within scope. Accordingly, embodiments of the present invention utilize at least two conductive ribbons, herein also referred to as "conductors" that are placed in mutual electrical contact for transmitting electrical signals. Thus in one respect, the conductors of the present invention are not individually insulated, or otherwise jacketed with an insulating material such as a dielectric, as commonly seen. In an embodiment the conductors are collectively housed in a jacket comprising an insulating material. Preferably the conductors are positioned in a substantially parallel configuration. Even more preferably, the conductors are positioned such that the respective surfaces of at least two conductors are in contact. This assembly is ideal for transmitting audio signals ranging from 0 to above 200 kHz. In this arrangement, the surface area of the conductors as a whole increases with each additional conductor resulting in a vastly improved cable assembly of extremely wide bandwidth, little resistance and very limited contact within the dielectric jacket. Furthermore, this design increases the conductor efficiency, and compactness.

In embodiments of the present invention the width of the cross-sectional profile of each conductor is substantially larger than the height. Respectively, the width is at least equal or greater than twice that of the height. In one embodiment, at least some conductors comprise a substantially rectangular cross-section. In another embodiment, at least some conductors comprise a substantially oval cross-section. Of course other regular or irregular geometric cross-sectioned designs are within scope where the width of the cross-sectional profile is substantially greater than the height. For instance, the cross-sectional profile may comprise curved in addition to straight lines. This may be further exemplified with a hybrid shape having oval and rectangular characteristics. Still further, in some embodiments the conductors comprise different cross-sectional profiles. That is, some are substantially rectangular and some are substantially oval, yet they are still in electrical contact. Preferably, the conductors are stacked such that their respective cross-sectional widths are lined up and parallel. However, staggered arrangement of the conductors is permissible, so long as electrical contact exists there between.

Materials suitable for conductors generally comprise all electrically conductive materials. Examples of such include, but are not limited to: gold, copper, silver, aluminum, conductive carbon, electrically conductive polymers, electrically-conductive composite materials or any combination thereof.

Materials suitable for a jacket generally comprise electrically insulating materials, preferably those classified as dielectrics. Examples of suitable materials include, but are not limited to: general classes of thermoset polymers, thermoplastic polymers and more specifically polyethylenes, polypropylenes, fluoropolymers, cross-linked polyethylenes, rubbers and combinations thereof. Furthermore the jacket may comprise additives such as flame retardant agents, mildew-proofing agents and various others.

The shape of the jacket may be that of substantially round, oval, square or rectangle in cross-section. Of course the jacket may also be shapeless such that it conforms to the outer surface of the conductors. In some cases the jacket may be snugly fitted about the conductors housed therein. As such, the conductors are substantially restrained from any vibrational motion in the radial direction. In other cases, the jacket may be loosely fitted about the conductors to allow for relative movement of the conductors in the radial direction of the cable. In either case the plurality of conductors may (or may not) be collectively fasted with a fastening mechanism such as but not limited to, plastic tag, adhesive and the like.

In another embodiment, the conductors are twisted (e.g. helically) at least partly along their length. This may serve to improve flexibility of the cable assembly on the whole.

The cable assemblies according to embodiments of the present invention may be terminated with a variety of connectors. Examples include but are not limited to: XLR, BNC, DIN, RCA, DB25 or variation thereof. Other examples include but are not limited to banana plugs, spades and the like.

Some embodiments are illustrated in the accompanying figures which may not serve to limit the scope the present invention in any manner. Accordingly, a cable assembly 2 is shown with various arrangements/configurations of conductors 4, jacket 6 and outer casing 8. The outer casing may be constructed from the same material as the jacket.

Figure 5:
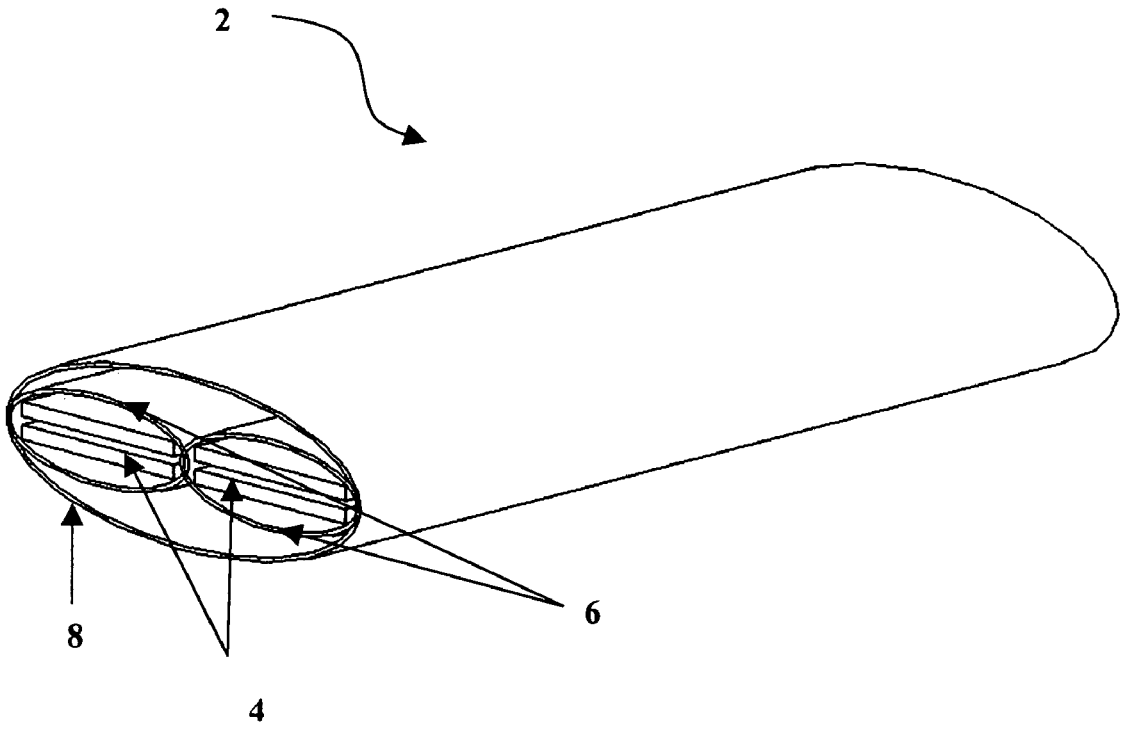
FIG. 5 represents an isometric view of a cable assembly with two sets of conductors.
Figure 6:
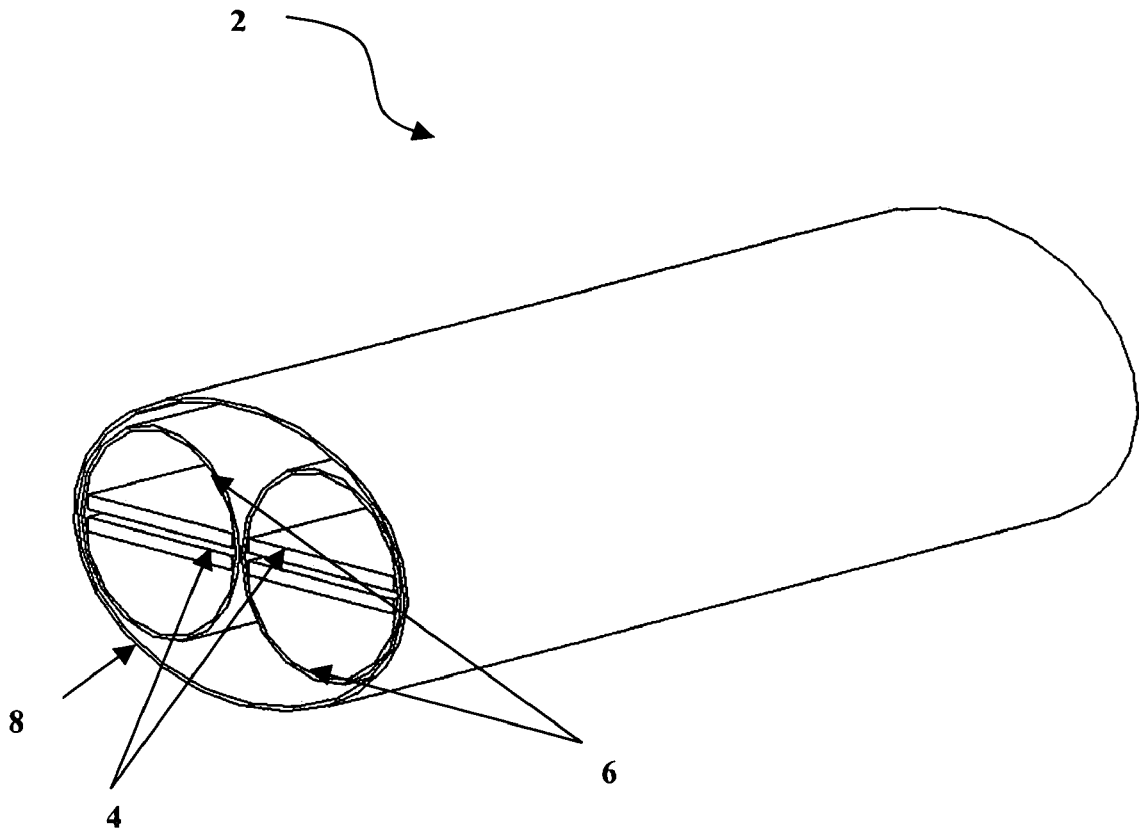
FIG. 6 represents another isometric view of a cable assembly with two sets of conductors.
Figure 7:
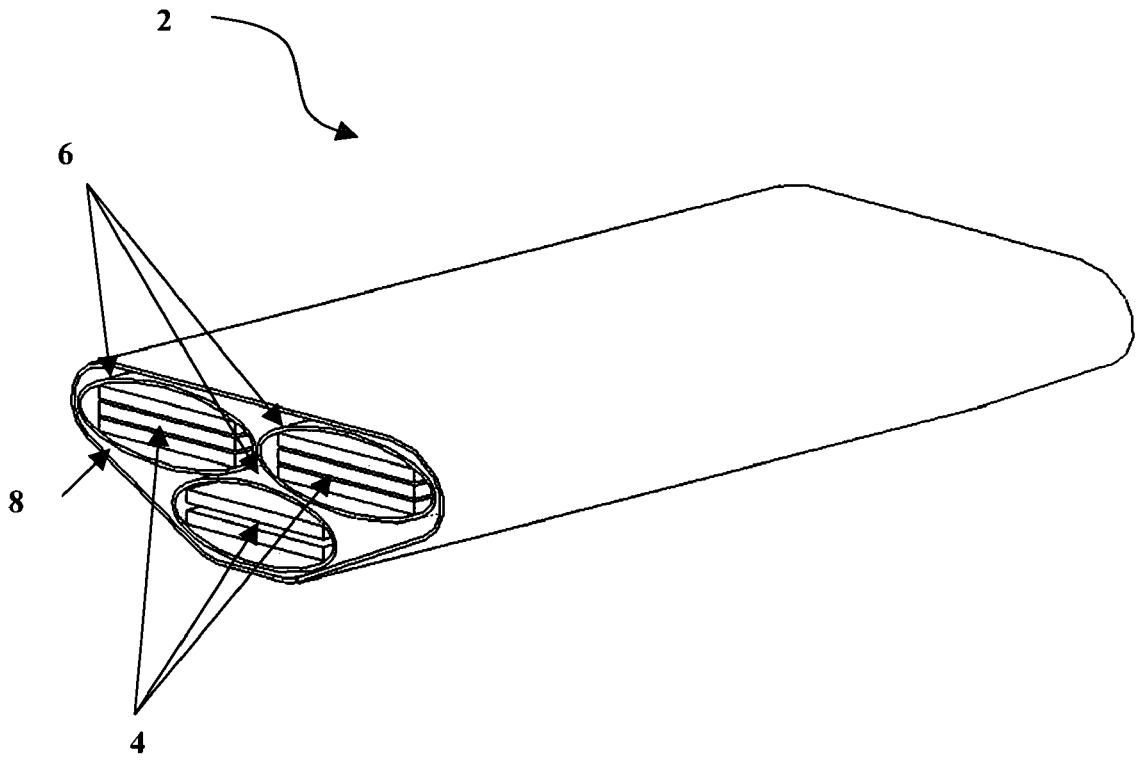
FIG. 7 represents an isometric view of a cable assembly with three sets of conductors.
Figure 8:
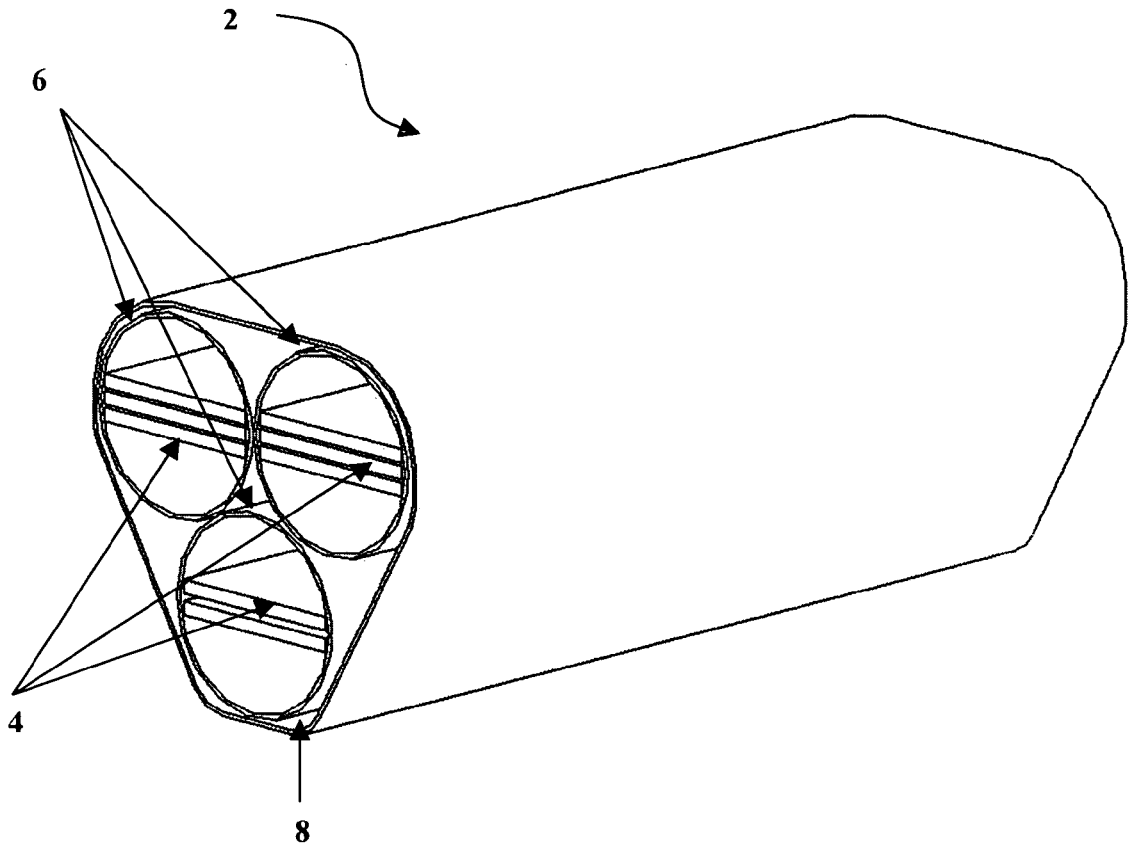
FIG. 8 represents another isometric view of a cable assembly with three sets of conductors.
Figure 9:
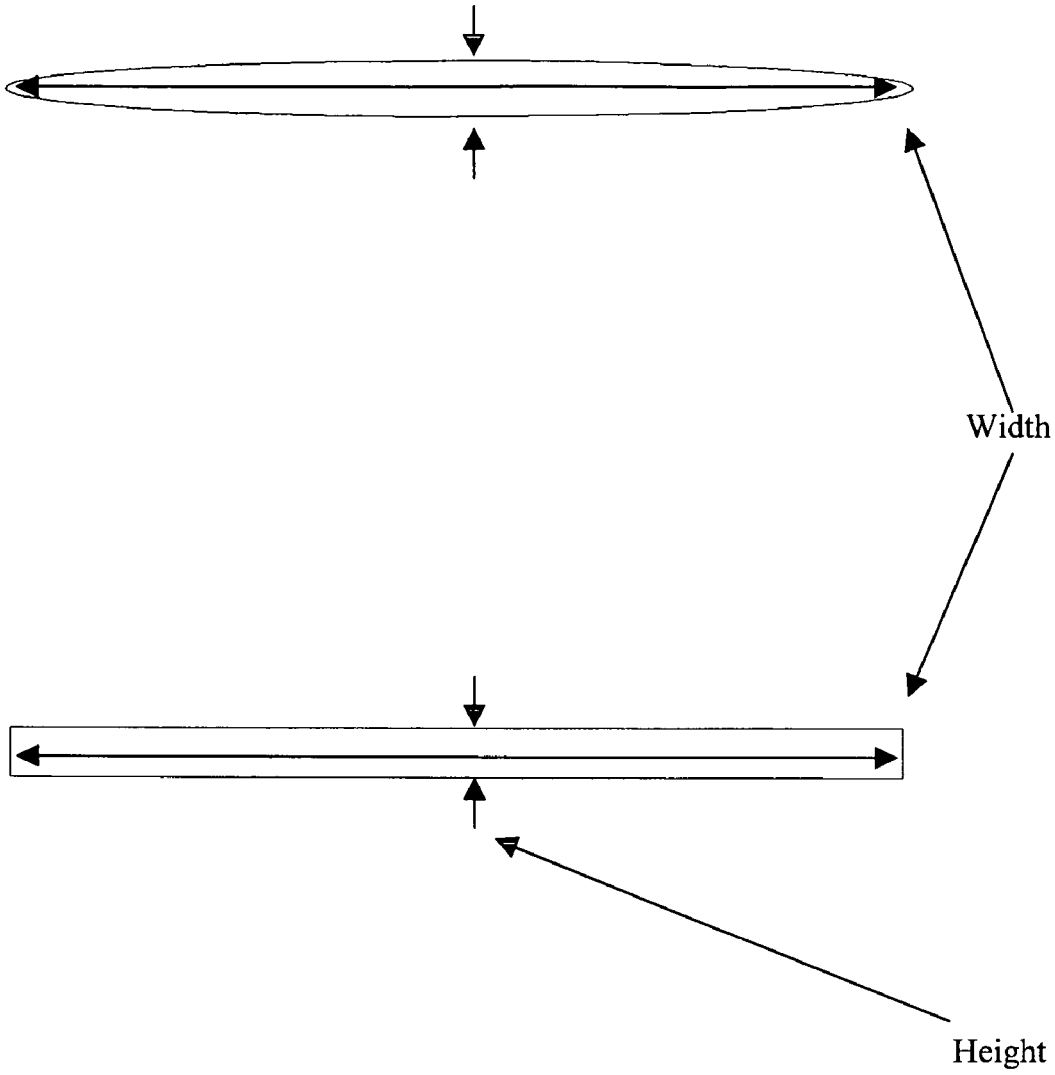
FIG. 9 represents two of many different possible cross-sectional profiles of a conductor, demonstrating conductors height and width.

A cable assembly in general may comprise more than one set of conductors held together. In one embodiment a cable assembly comprises at least two sets of conductors packaged within an outer casing. As in previous embodiments, each set of conductors which comprise at least two conductors in electrical contact, are enclosed in an insulating material, preferably a dielectric. For instance in FIGS. 5 and 6 a cable assembly with two sets of conductors is shown. Each conductor set may transmit the same electrical signal or not. For example one set may represent the negative component of a signal while the other the positive. In another example, illustrated in FIGS. 7 and 8, three sets of conductors are shown. Again all three may transmit the same signal or not. In one example the three sets of conductors may serve as a negative, a positive and a ground component of a cable assembly. Of course, a cable assembly may comprise more than three sets of conductors depending on the application of interest.

In yet another embodiment, a shield is placed adjacent to the jacket. One function of the shield may be to protect the conductors from EMI's. The shield may be applied by spraying the inner or outer surface of the jacket with metallic paint containing particles of copper, silver, gold, aluminum, nickel, carbon (including graphite), or other electrically conducting materials. Alternatively, the shield may be applied by co-extruding a suitable electrically conducting material with the jacket material, depositing a layer of electrically-conductive material on the jacket, or installing a foil or braided wrapping adjacent to the jacket. Where the cable assembly comprises two or more sets of conductors, each set may comprise a shield. In some cases it may be preferable for, the shields themselves to be in electrical contact.

What is claimed is:

1. A cable assembly, comprising:

at least two ribbon conductors for transmitting a single electronic signal, said ribbon conductors not individually insulated;

an insulating jacket;

said ribbon conductors disposed inside said insulating jacket such that a gap exists between each said ribbon conductor and said insulating jacket;

said insulating jacket loosely fitted around said ribbon conductors to allow relative movement of said ribbon conductors in a radial direction; and, each said ribbon conductor making electrical contact with at least one other said ribbon conductor.

2. A cable assembly according to claim 1, further including:

at least one of said ribbon conductors having an oval cross sectional shape having two opposite convex ends and two opposite convex sides.

3. A cable assembly according to claim 1, further including:

at least one of said ribbon conductors having a rectangular cross sectional shape; and, at least one of said ribbon conductors having an oval cross sectional shape having two opposite convex ends and two opposite convex sides.

* * * * *